United States Patent [19]

Lach et al.

[11] Patent Number: 4,908,239

[45] Date of Patent: Mar. 13, 1990

[54] FINISHING OF LEATHER

[75] Inventors: Dietrich Lach, Friedelsheim; Guenter Eckert, Limburgerhof; Werner Maltry, Gorxheimertal; Karl Fischer, Bad Duerkheim, all of Fed. Rep. of Germany

[73] Assignee: BASF Aktiengesellschaft, Ludwigshafen, Fed. Rep. of Germany

[21] Appl. No.: 261,928

[22] Filed: Oct. 25, 1988

[30] Foreign Application Priority Data

Oct. 28, 1987 [DE] Fed. Rep. of Germany ..... 3736475

[51] Int. Cl.[4] ..... B05D 3/02

[52] U.S. Cl. ..... 427/389; 8/94.1 R; 8/94.21

[58] Field of Search ..... 8/94.1 R, 94.21, 127.6; 427/338, 340, 341, 369, 389

[56] References Cited

U.S. PATENT DOCUMENTS 4,374,872 2/1983 Eckert et al. ..... 8/94.21
4,491,612 1/1985 Fischer ..... 427/412

FOREIGN PATENT DOCUMENTS 3127598 3/1982 Fed. Rep. of Germany .... 8/94.1 R
3228128 2/1984 Fed. Rep. of Germany .... 8/94.1 R

OTHER PUBLICATIONS

Wallace Windus and Editor Emeritus H. B. Merrill, "Leather and Related Materials", Chemical Abstracts, vol. 66, pp. 2896 and 2897, 1967, CA: 66:30038y.

*Primary Examiner*—Paul Lieberman
*Assistant Examiner*—John F. McNally
*Attorney, Agent, or Firm*—Oblon, Spivak, McClelland, Maier & Neustadt

[57] ABSTRACT

Leather is finished on the basis of a purely aqueous system using aqueous polymer dispersions, casein and crosslinking agents in the bottoming and seasoning.

11 Claims, No Drawings

FINISHING OF LEATHER

The present invention relates to a process for finishing leather on the basis of a purely aqueous system using aqueous polymer dispersions, casein and crosslinking agents in the bottoming and seasoning.

The purpose of applying a finish (or coating) to leather is to confer on the tanned, fatliquored and perhaps dyed raw leather the desired appearance, specific hand properties and the necessary end-use fastness properties, for example flex elasticity, water fastness and wet and dry rub fastness. Good values for these properties were hitherto only obtainable with systems containing organic solvents. However, modern concerns about health and the environment make it necessary to finish leather with purely aqueous systems. The results of the prior art proposals are not satisfactory because at least one of the required properties, such as flex elasticity, wet and dry rub fastness or adhesion, is not up to the required standard.

For instance, EP Patent No. 100,493 describes specific acrylate dispersions for a purely aqueous finishing system. It is true that it gives good to adequate physical fastness properties, but in particular the organoleptic properties of the finished leather, such as appearance or hand, leave something to be desired. The leather obtained has in some instances an unnatural surface and a certain plasticlike hand.

It is also known in the art to apply aqueous mixtures of casein and condensation products of melamine and/or urea with formaldehyde and/or glyoxal and bring about a crosslinking at elevated temperatures. This process too does not always give satisfactory results.

It is an object of the present invention to provide an aqueous finishing process for leather giving optimal performance characteristics.

We have found that this object is achieved with a process for finishing leather by application of an aqueous mixture of at least one dispersed polymer, casein and a crosslinking agent layer by layer, by applying an aqueous mixture containing, based on weight of solids, from 2 to 15% by weight, preferably from 5 to 12% by weight, of one or more polymeric binders, from 2 to 10% by weight, preferably from 2.5 to 7% by weight, of casein, from 3 to 15% by weight, preferably from 4.5 to 10% by weight, of a crosslinker and ad 100% by weight of water, in layers to the leather from 2 to 6 times up to a total amount of from 10 to 100 g of solids/$m^2$ of leather surface area, drying after every application at from 20° to 80° C., and fixing from 1 to 3 times at from 140° to 200° C., preferably at from 170° to 180° C., in the course of a total contact time of from 0.1 to 5 seconds, preferably of from 0.3 to 2 seconds.

In what follows, particulars of the process according to the invention will be described:

It is advantageous to use polymeric binders or mixtures of polymeric binders which form sufficiently water-resistant films. The wet strength can be tested for example by measuring the water regain of dried films in accordance with German Standard Specification DIN No. 53,459. In general, use is made of polymeric binders which do not regain more than 30% by weight of water in the course of 24 hours. Copolymers which are suitable and recommendable for use as binders are known per se to those skilled in the art and can be taken from the prior art. More particularly, aqueous dispersions based on acrylates or on copolymers with vinyl chloride or vinylidene chloride as main constituent come into consideration.

Specific examples are copolymers composed of from 30 to 85, preferably from 60 to 80, % by weight of a $C_2$–$C_6$-alkyl ester of acrylic or methacrylic acid, preferably ethyl, n-propyl or n-butyl acrylate, from 1 to 8% by weight, preferably from 2 to 5% by weight, of a carboxyl-containing monomer, such as acrylic acid, methacrylic acid, crotonic acid or maleic acid, of which comonomers acrylic acid is preferred, and from 7 to 65, preferably from 15 to 38, % by weight of at least one comonomer, such as acrylonitrile, acrylamide, methacrylamide, vinyl chloride, vinyl acetate and/or styrene.

Of these, monomer mixtures of from 70 to 80% by weight of n-butyl acrylate, from 2 to 5% by weight of acrylic acid, from 12 to 18% by weight of acrylonitrile, from 1 to 5% by weight of methacrylamide and optionally from 10 to 15% by weight of styrene are particularly recommendable.

Also suitable are copolymers containing from 50 to 90, preferably from 55 to 70, % by weight of vinylidene chloride, from 10 to 50, preferably from 25 to 50, % by weight of a $C_2$–$C_4$-alkyl ester of acrylic or methacrylic acid, in particular ethyl or n-butyl acrylate, with from 0 to 5, preferably from 1 to 3, % by weight of N-methylolacrylamide or N-methylolmethacrylamide and with or without from 1 to 5, preferably from 1 to 3, % by weight of acrylamide or methacrylamide.

It is also possible to use copolymers composed of from 50 to 90, preferably from 65 to 85, % by weight of vinyl chloride and from 10 to 50, preferably from 15 to 35, % by weight of a $C_1$–$C_4$-alkyl ester of acrylic or methacrylic acid and also from 0 to 5, preferably from 0 to 3, % by weight of acrylamide or methacrylamide.

Of these, a mixture of from 75 to 85% by weight of vinyl chloride and from 15 to 25% by weight of methyl acrylate is particularly recommendable.

Consideration can also be given for example to copolymers of from 80 to 90% by weight of ethyl acrylate and from 10 to 20% by weight of acrylonitrile.

Suitable polymeric binders also include copolymers incorporating a relatively high proportion of acrylic esters, for example from 90 to 98% by weight of at least one acrylic or methacrylic ester of from 1 to 4 carbon atoms in the ester alcohol, and from 2 to 10% by weight, preferably from 4 to 6% by weight, of acrylic or methacrylic acid and, optionally, an amide thereof.

Usable polymeric binders advantageously and preferably also include aqueous ionomeric polyester-polyurethane dispersions. Binders of this type are known e.g. from U.S. Pat. No. 3,479,310 and UK Patent No. 1,339,357.

In general, they are dispersions of polyesterols of adipic acid and one or more aliphatic diols, for example hexanediol and neopentylglycol, and polyurethanes from aliphatic, cycloaliphatic and aromatic diisocyanates, such as toluylidene diisocyanate and hexamethylene diisocyanate, with an aliphatic diol, for example 1,4-butanediol. An Example of a product of this type is known by the trade name Astacin® Finish PUD.

The abovementioned binders are known and in some instances commercially available. They may also be used mixed with one another.

The casein binders used in the process according to the invention are the commercially available, generally from 8 to 25% strength by weight, aqueous or colloidal casein solutions. These may contain additives known per se to those skilled in the art, for example sulfonated castor oil, cationically emulsified groundnut oil, montan wax emulsions, polyglycol ethers and the like. The casein may have been subjected to alkaline hydrolysis and modified, for example with caprolactam.

The crosslinking agents used, in particular for the casein, are advantageously condensation products of melamine and/or urea with formaldehyde.

The crosslinking condensation products of melamine and/or urea with formaldehyde and with or without glyoxal, whose methylol groups may be wholly or partly etherified, comprise the customary commercially available solutions or reaction mixtures of these condensation products or dry powder therefrom. The condensation products used should give clear or slightly cloudy colloidal solutions in water or 1:1 mixtures of water and n-propanol. Preference is given to using commercial aqueous solutions having solids contents of from 30 to 70% by weight.

The condensation products used as crosslinkers can be characterized for example as follows:

Condensation products based on urea are reaction mixtures obtained by reacting 1 mole of urea with from 1.6 to 4, preferably from 1.8 to 2.8, moles of formaldehyde. If desired, the methylol groups present may be etherified by reaction with methanol or ethanol.

We have observed that, if urea-formaldehyde-glyoxal condensation products are used, the shine on the finished leather can be increased as compared with when the above-mentioned urea-formaldehyde products are used. Advantageous condensation products are the reaction products of 1 mole of urea with from 2 to 3.5 moles of formaldehyde and from 0.1 to 1.5 moles of glyoxal. Very particular preference is given to a condensation product of 1 mole of urea, 3 moles of formaldehyde and 0.5 mole of glyoxal.

Of the melamine derivatives, it is in particular condensation products of 1 mole of melamine and from 2 to 6 moles of formaldehyde, preferably from 2.2 to 5.5 moles of formaldehyde, which have proved useful. It is advantageous if the methylol groups are present in etherified form, in particular as methyl ethers. Particular preference is therefore given to reaction products of 1 mole of melamine and from 2.2 to 6 moles of formaldehyde and from 2.2 to 6 moles of methanol. Specific instances thereof are the hexamethylolmelamine hexamethyl ether and the condensation product of 1 mole of melamine, 5.5 moles of formaldehyde and 5.5 moles of methanol, which are each commercially available in the form of their technicalgrade aqueous solutions having a solids content of from 30 to 70% by weight or in powder form.

Melamine-urea-formaldehyde condensation products obtained by reacting 1 mole of melamine, from 0.1 to 6 moles of urea, from 2.5 to 3.8 moles of formaldehyde with or without from 0.5 to 3.8 moles of methanol for etherification have proved useful.

It is also possible to use melamine-formaldehyde-glyoxal condensation products of 1 mole of melamine, from 1.4 to 3.5 moles of formaldehyde and from 0.2 to 1 mole of glyoxal.

It is also possible to use dicyandiamide- and biuret-formaldehyde condensation products. It is also possible to use mixtures of the abovementioned condensation products. It is to be noted that for example aziridine compounds can be included as additional crosslinking agents.

The finishing mixes according to the invention may of course contain the customary additives, for example soluble dyes and/or pigment formulations for coloring, oil or wax emulsions for improving the plating and the hand, and any further assistants usable in the finishing of leather. Customary additives, to be added in an amount of from 1 to 10, preferably of from 1 to 6, % by weight, based on the dispersions, are for example high-boiling polyglycols, phthalic esters, ethylene glycol, waxes of natural or synthetic origin and also fungicides.

The crosslinking agents mentioned give good crosslinking, as is verifiable by testing the wet rub fastness in accordance with IUF 450 and the flexibility in accordance with IUP 20.

In general, in the preparation of the solutions or mixtures to be applied the crosslinking agents were used in the form of their from 30 to 80% strength by weight aqueous solutions or in powder form.

As for the rest, the finishing of the leather by the process according to the invention takes a conventional form:

In general, from 2 to 6 layers are applied by spraying, casting, plushing or printing, preferably by spraying, each layer being dried at from 20° to 80° C. before the next layer is applied in the same or another composition. Instead of or in addition to being dried between applications of layers, the leather can be plated at the stated temperatures. In general, this plating advantageously takes place after all of the bottoming has been applied.

This is followed by the application of the seasoning layers, which are dried in the same way.

The mixtures applied as bottoming on the one hand and seasoning on the other generally differ in composition only in that the bottoming forms a more flexible film, which may be more highly pigmented than the seasoning, which in turn should form a more rigid film.

Finally, the coating on the leather is fixed or crosslinked by subjecting the coated leather to the above-specified heat treatment.

In total, it is advantageous to apply from 10 to 100 g of solids/$m^2$ of leather surface area by the process according to the invention to obtain the desired effects.

A relatively high proportion of polymeric binder generally leads in the final plating to a higher shine on account of the thermoplastic properties of the polymers used. The use of higher amounts of polymeric binder is indicated wherever this shine is desirable. If leathers are to be given a mat finish, it is advisable to use a higher proportion of casein. Such finishes are based on particularly water-resistant polymeric binders, and the amount of crosslinking agent is increased in line with the amount of casein.

Regarding fixing, it is observed that the higher temperatures and/or longer contact times make it possible, if desired, to obtain a more water-resistant film on the leather.

It may be remarked that the finishing mixes are easy to prepare. The crosslinking agents can be incorporated at room temperature into the mix together with casein without thereby immediately setting off a reaction. If problems arise with the dissolving of crosslinking agents in powder form, it is advantageous to use warm water at about 40° C. or, where appropriate, a mixture with n-propanol (from 1 to44 parts of water and 1 part of n-propanol).

The process according to the invention gives excellent finishes, as is verifiable by testing the wet rub fastness of the leather in accordance with IUF 450 and the flexibility of the leather in accordance with IUP 20.

The Examples below further illustrate the process according to the invention. Parts and percentages are by weight, unless otherwise stated.

EXAMPLE 1

Finishing of cattle leather for apparel (a) bottoming 450 parts of water, 80 parts of a 70% strength by weight aqueous solution of a melamine resin obtained by condensation of 1 mole of melamine, 5.5 moles of formaldehyde and 5.5 moles of methanol, 40 parts of a 20% strength by weight commercially available matting agent based on silica, 150 parts of a 16% strength by weight aqueous casein solution blended with castor oil, 50 parts of an 18% strength by weight aqueous casein solution blended with a montan wax emulsion, 150 parts of a 40% strength by weight aqueous acrylate dispersion of a copolymer of 76.5% by weight of n-butyl acrylate, 17.5% by weight of acrylonitrile, 4% by weight of acrylic acid and 2% by weight of methacrylamide (the water regain of a film of this acrylate dispersion in 24 hours being 27%), 50 parts of a 15% strength by weight aqueous pigment formulation and 30 parts of a liquid dye formulation.

This bottoming mixture is applied by spraying in 3 coats by means of a compressed air gun in a total amount of 45 g of solids/m$^2$ of leather surface area. After each application the leather is dried at 80° C. and plated at 70° C.

(b) seasoning 552 parts of water, 3 parts of a silicone-based wax emulsion, 80 parts of a 70% strength by weight aqueous solution of a melamine resin as specified under Example 1a), 30 parts of a 20% strength by weight matting agent based on silica, 160 parts of a 16% strength by weight aqueous casein solution blended with sulfonated castor oil, 80 parts of an 18% strength by weight aqueous casein solution blended with polyglycol ether, 80 parts of a 40% strength by weight aqueous acrylate dispersion of a copolymer of 85% by weight of ethyl acrylate and 15% by weight of acrylonitrile (the water regain of a film of this copolymer in 24 hours being 25%), 5 parts of a 15% strength by weight aqueous pigment formulation and 10 parts of a liquid dye formulation.

This mixture is applied to the bottomed leather by spraying in 2 coats, each being dried at 80° C., in a total amount of 22 g of solids/m$^2$. Crosslinking is effected on a continuous plating machine by plating twice at 170° C. in the course of a total contact time of 1.6 seconds.

The cattle nappa leather obtained is drum-milled for 6 hours, strained lightly on a frame and subsequently plated once more at 80° C. and 15 bar on a hydraulic plating press. The leather thus finished shows the desired smooth hand and silky shine. The leather surface looks natural, appearing free of excessive coating. A good wet rub fastness and excellent elasticity, as measured by the degree of damage to the leather surface in accordance with IUF 450 and IUP 20, are obtained.

EXAMPLE 2

Cattle side leather for shoes (a) bottoming 525 parts of water, 65 parts of a 75% strength by weight aqueous solution of a urea resin obtained by condensation of 1 mole of urea with 3 mole of formaldehyde and 0.5 mole of glyoxal, 200 parts of a 16% strength by weight aqueous casein solution with sulfonated castor oil and cationically emulsified groundnut oil, 150 parts of an aqueous dispersion containing 67.5 parts of a 50% strength by weight dispersion of a copolymer of 70% by weight of n-butyl acrylate, 13% by weight of acrylonitrile, 13% by weight of styrene, 2% by weight of acrylic acid and 2% by weight of methacrylamide, 45 parts of a 40% strength by weight acrylate dispersion as described in Example 1a) and 37.5 parts of a 50% strength by weight dispersion of a copolymer of 80% by weight of vinyl chloride and 20% by weight of methyl acrylate, 40 parts of a 15% strength by weight aqueous pigment formulation and 20 parts of a liquid dye formulation.

This bottoming is applied by spraying in 3 coats, each dried and plated at 75° C., in a total amount of 35 g of solids/m$^2$.

(b) seasoning 540 parts of water, 85 parts of a 75% strength by weight aqueous solution of a urea resin as described in Example 2a), 100 parts of a 20% strength by weight aqueous casein solution with sulfonated castor oil and cationically emulsified groundnut oil, 100 parts of an aqueous 15% strength by weight casein solution, 150 parts of an aqueous dispersion of acrylate copolymers as described in Example 2a), 10 parts of a 25% strength by weight pigment formulation and 15 parts of a liquid dye formulation.

This mixture is applied to the bottomed leather by spraying in 2 coats, each dried at 75° C., in a total amount of 17 g of solids/m$^2$. Crosslinking is carried out on a continuous plating machine by plating the leather twice at 160° C. for a total contact time of 1.3 seconds.

The cattle side leather obtained is subsequently plated at 70° C. and 20 bar on a hydraulic plating machine to improve the surface smoothness.

The side leather for shoes thus finished conforms in its external properties to the requirements of the market. The leather surface shows good elasticity and water fastness, as measured by the degree of damage to the leather in accordance with IUP 20 and IUF 450.

EXAMPLE 3

Cattle nappa for upholstery leather (a) bottoming 540 parts of water, 40 parts of a pulverulent melamine resin obtained by condensation of 1 mole of melamine and 3.5 moles of formaldehyde, 30 parts of a 20% strength by weight matting agent based on silica, 200 parts of an aqueous 18% strength by weight casein solution with sulfonated castor oil and cationically emulsified groundnut oil,
50 parts of a 40% strength by weight aqueous ionomeric polyester-polyurethane dispersion (trade name Astacin Finish PUD), (the water regain of a film of this copolymer in 24 hours being 29%),
100 parts of an aqueous 40% strength by weight acrylate dispersion as described in Example 1a), and
40 parts of an aqueous 42% strength by weight pigment formulation.

This mixture is applied by spraying in 4 coats, each dried at 70° C. and plated at 80° C., in a total amount of 70 g of solids/m$^2$.

(b) seasoning
590 parts of water,
50 parts of a pulverulent melamine resin as described in Example 3a),
50 parts of a 20% strength by weight matting agent based on silica,
140 parts of an aqueous 20% strength by weight casein solution with sulfonated castor oil and cationically emulsified groundnut oil,
50 parts of a 40% strength by weight aqueous ionomeric polyester-polyurethane dispersion as described in 3a),
50 parts of an aqueous 40% strength by weight acrylate dispersion of a copolymer of 85% by weight of ethyl acrylate and 15% by weight of acrylonitrile (the water regain of a film of this copolymer in 24 hours being 23%),
10 parts of an aqueous 42% strength by weight pigment formulation and
60 parts of an aqueous 50% strength by weight casein solution.

This mixture is applied by spraying to the bottomed leather in 2 coats, each dried at 70° C., in a total amount of 33 g of solids/m$^2$. Fixing is effected on a continuous plating machine at 175° C. in a total contact time of 1.2 seconds.

The leather obtained is drum-milled, strained on a frame and pressed at 60° C. and 30 bar on a hydraulic plating press to obtain smoothness.

The upholstery leather finished in this way shows the desired gloss, the right hand and a sufficiently water-resistant surface and excellent elasticity in accordance with IUF 450 and IUP 20, measured by the degree of damage to the leather surface.

EXAMPLE 4

Goat leather for bagmakers' goods (a) bottoming
605 parts of water,
65 parts of a 70% strength by weight aqueous solution of a melamine resin obtained by condensation of 1 mole of melamine, 5.5 moles of formaldehyde and 5.5 moles of methanol as described in Example 1a),
175 parts of a 16% strength by weight aqueous casein solution with sulfonated castor oil,
110 parts of an aqueous 40% strength by weight acrylate dispersion as described in Example 1a),
20 parts of a 32% strength by weight aqueous pigment formulation and
25 parts of a liquid dye formulation.

This mixture is applied by spraying in 3 coats, each dried at 60° C. and plated at 100° C., in a total amount of 38 g of solids/m$^2$.

(b) seasoning
580 parts of water,
80 parts of an aqueous melamine resin solution as described in Example 1a),
80 parts of a 20% strength by weight aqueous casein solution with sulfonated castor oil,
160 parts of a 15% strength by weight aqueous casein solution,
80 parts of a 40% strength by weight acrylate dispersion as described in Example 1b) and
20 parts of a liquid dye formulation.

This mixture is applied to the bottomed leather by spraying in 2 coats, each dried at 60° C., in a total amount of 18 g of solids/m$^2$. Crosslinking is effected on a continuous plating machine by plating three times at 180° C. for a total contact time of 1.8 seconds. To obtain smoothness, the leather is treated on a hydraulic plating machine at 100° C.

The finished goat leather has the properties required for bagmakers' goods, namely high gloss, smooth hand and good water resistance, as measured in accordance with IUF 450.

EXAMPLE 5

Finishing of sheep skin for apparel (a) bottoming
555 parts of water,
30 parts of a 20% strength by weight matting agent based on silica,
30 parts of a 30% strength by weight montan wax emulsion,
200 parts of an acrylate dispersion as described in Example 2a),
100 parts of an aqueous 40% strength by weight acrylate dispersion as described in Example 1a),
70 parts of a 15% strength by weight aqueous pigment formulation and
15 parts of a liquid dye formulation.

This mixture is applied by spraying in 2 coats, each dried and plated at 70° C., in a total amount of 22 g of solids/m$^2$.

(b) seasoning
550 parts of water,
40 parts of a 70% strength by weight aqueous melamine resin solution as described in Example 1a),
30 parts of a 20% strength by weight matting agent based on silica,
150 parts of an 18% strength by weight aqueous casein solution with a montan wax emulsion,
220 parts of an acrylate dispersion as described in Example 1b), and
10 parts of a 15% strength by weight pigment formulation.

This mixture is applied to the bottomed leather by spraying in 2 coats, each dried at 80° C., in a total amount of 15 g of solids/m$^2$ of leather surface area. Crosslinking is effected by plating twice at 175° C. for a total contact time of 0.8 seconds.

In this Example, the mixture according to the invention is applied to a customary leather bottomed without casein. The finished leather shows the desired hand and shine. The leather surface has an natural appearance, good water fastness in accordance with IUF 450 and sufficient elasticity in accordance with IUP 20, as measured by the degree of damage to the coated leather surface.

We claim:

1. A process for finishing leather by application of an aqueous mixture of at least one dispersed polymeric binder, casein and a crosslinking agent layer by layer, comprising:

applying an aqueous mixture comprising, based on the weight of solids, from 2 to 15% by weight of one or more polymeric binders, selected from the group of copolymers consisting of:

(A) 30 to 85% by weight of a $C_2$–$C_6$-alkyl ester of acrylic or methacrylic acid, 1 to 8% by weight of a carboxyl-containing monomer and 7 to 65% by weight of at least one comonomer selected from the group consisting of acrylonitrile, acrylamide, methacrylamide, vinyl chloride, vinyl acetate, and styrene, (B) 50 to 90% by weight of vinylidene chloride, 10 to 50 % by weight of a $C_2$–$C_4$-alkylester of acrylic or methacrylic acid, 0 to 5% by weight of N-methylolacrylamide or N-methylolmethacrylamide, and 0% or 1 to 5% by weight of acrylamide or methacrylamide, (C) 50 to 90% by weight of vinyl chloride, 10 to 50% by weight of a $C_1$–$C_4$-alkylester of acrylic or methacrylic acid, and 0 to 5% by weight of acrylamide or methacrylamide, (D) 80 to 90% by weight of ethyl acrylate, and 10 to 20% by weight of acrylonitrile, (E) 90 to 98% by weight of at least one $C_1$–$C_4$-alkylester of acrylic or methacrylic acid, and 2 to 10% by weight of acrylic or methacrylic acid or an amide thereof, and (F) polyesterols of adipic acid and one or more aliphatic diols and polyurethanes prepared from aliphatic, cycloaliphatic, and aromatic diisocyanates and an aliphatic diol, and mixtures thereof, from 2 to 10% by weight of casein, from 2 to 15% by weight of a crosslinking agent which is a condensation product of melamine, urea or mixtures thereof with formaldehyde, or further condensed with glyoxal, the methylol groups of this condensation product being wholly or partly etherified, or a condensation product of dicyandiamide or biuret with formaldehyde, or a condensation of dicyandiamine or biuret with formaldehyde further containing an aziridine compound as additional crosslinking agent, ad 100% by weight of water, in layers to leather from 2 to 6 times up to a total amount of from 10 to 100 g of solids/$m^2$ of leather surface area, drying after every application at from 20° to 80° C., and fixing from 1 to 3 times at from 150° to 220° C. in the course of a total contact time of from 0.1 to 5 seconds.

2. The process according to claim 1, wherein the polymeric binder consists of 30 to 85% by weight of a $C_2$–$C_6$-alkyl ester of acrylic or methacrylic acid, 1 to 8% by weight of a carboxyl-containing monomer and 7 to 65% by weight of at least one comonomer selected from the group consisting of acrylonitrile, acrylamide, methacrylamide, vinyl chloride, vinyl acetate, and styrene.

3. The process according to claim 1, wherein the polymeric binder consists of 50 to 90% by weight of vinylidene chloride, 10 to 50% by weight of a $C_2$–$C_4$-alkylester of acrylic or methacrylic acid, 0 to 5% by weight of N-methylolacrylamide or N-methylolmethacrylamide, and 0% or 1 or 5% by weight of acrylamide or methacrylamide.

4. The process according to claim 1, wherein the polymeric binder consists of 50 to 90% by weight of vinyl chloride, 10 to 50% by weight of a $C_1$–$C_4$-alkylester of acrylic or methacrylic acid, and 0 to 5% by weight of acrylamide or methacrylamide.

5. The process according to claim 1, wherein the polymeric binder consists of 80 to 90% by weight of ethyl acrylate, and 10 to 20% by weight of acrylonitrile.

6. The method according to claim 1, wherein the polymeric binder consists of 90 to 98% by weight of at least one $C_1$–$C_4$-alkylester of acrylic or methacrylic acid, and 2 to 10% by weight of acrylic or methacrylic acid or an amide thereof.

7. The process according to claim 1, wherein the polymeric binder consists of polysterols of adipic acid and one or more aliphatic diols and polyurethanes prepared from aliphatic, cycloaliphatic, and aromatic diisocyanates and an aliphatic diol.

8. The process according to claim 1, wherein the crosslinking agent is a condensation product of melamine, urea, or mixtures thereof with formaldehyde, the methylol groups of this condensation product being wholly or partly etherified.

9. The process according to claim 8, wherein the condensation product is further condensed with glyoxal.

10. The process according to claim 1, wherein the crosslinking agent is a condensation product of dicyandiamine or biuret with formaldehyde.

11. The process according to claim 10, wherein the condensation product contains an aziridine compound as additional crosslinking agent.

* * * * *